US008850642B2

(12) United States Patent
Rasmussen

(10) Patent No.: US 8,850,642 B2
(45) Date of Patent: Oct. 7, 2014

(54) SUPPORT DEVICE AND METHODS

(71) Applicant: Steven W. Rasmussen, Golden, CO (US)

(72) Inventor: Steven W. Rasmussen, Golden, CO (US)

( * ) Notice: Subject to any disclaimer, the term of this patent is extended or adjusted under 35 U.S.C. 154(b) by 0 days.

(21) Appl. No.: 13/856,251

(22) Filed: Apr. 3, 2013

(65) Prior Publication Data

US 2013/0276236 A1 Oct. 24, 2013

Related U.S. Application Data

(60) Provisional application No. 61/635,144, filed on Apr. 18, 2012.

(51) Int. Cl.

| | |
|---|---|
| ***A47C 20/00*** | (2006.01) |
| ***A47B 7/00*** | (2006.01) |
| ***A47C 1/10*** | (2006.01) |
| ***A47G 9/10*** | (2006.01) |
| ***A47C 16/00*** | (2006.01) |

(52) U.S. Cl.

CPC ..... *A47G 9/1027* (2013.01); *A47C 16/00* (2013.01)

USPC ..... 5/640; 5/622; 5/636; 5/637; 297/398

(58) Field of Classification Search

CPC ..... A61G 13/121; A61G 13/12; A61G 2200/325; A61G 7/072; A47C 20/026

USPC ..... 5/603, 622, 636, 637, 640, 643; 297/392, 397, 398; 206/234

See application file for complete search history.

(56) References Cited

U.S. PATENT DOCUMENTS

| | | | | | |
|---|---|---|---|---|---|
| 682,871 | A | * | 9/1901 | Hogan et al. | 5/644 |
| 1,515,886 | A | * | 11/1924 | Rumsey | 27/13 |
| 2,314,771 | A | * | 3/1943 | Compton | 5/640 |
| 2,398,940 | A | * | 4/1946 | Jones | 5/622 |

(Continued)

FOREIGN PATENT DOCUMENTS

| | | | | |
|---|---|---|---|---|
| EP | 1898747 | A2 | 3/2008 | |
| FR | 2789974 | A1 * | 8/2000 | B65D 5/50 |

(Continued)

OTHER PUBLICATIONS

"Headrest (barkin) from the Boni or Somali People of Somalia", located at www.randafricanart.com/Boni_headrest_2_Somalia.html.

(Continued)

*Primary Examiner* — William Kelleher
*Assistant Examiner* — Eric Kurilla
(74) *Attorney, Agent, or Firm* — Mark D. Trenner; Trenner Law Firm, LLC

(57) ABSTRACT

A support device such as a head support is disclosed. The head support has a frame configured for arrangement between collapsed and assembled dispositions. The head support may also have a pad and/or a cushion. In an example, the frame includes a base, a front riser, a support and a rear riser. After assembly, the central plane of the front riser is configured at an angle relative to the central planes of the base and the support, and may be substantially parallel with the central plane of the rear riser. To prepare the head support for transport, the central plane of the base can be configured substantially parallel to central planes of the front riser, the support, and the rear riser.

14 Claims, 6 Drawing Sheets

(56) References Cited

U.S. PATENT DOCUMENTS

| | | | | |
|---|---|---|---|---|
| 2,663,029 | A * | 12/1953 | Whitley et al. | 5/634 |
| 2,817,473 | A * | 12/1957 | Foster | 206/149 |
| 3,241,160 | A * | 3/1966 | Escobar | 5/418 |
| 3,581,883 | A * | 6/1971 | Whitney | 206/591 |
| 4,340,985 | A * | 7/1982 | Potter | 5/636 |
| 4,416,371 | A * | 11/1983 | Nauheimer | 206/289 |
| 4,752,064 | A * | 6/1988 | Voss | 5/638 |
| 4,828,321 | A | 5/1989 | Harper | |
| 5,007,569 | A * | 4/1991 | Zarb | 224/275 |
| 5,060,792 | A * | 10/1991 | Oliff | 206/140 |
| 5,269,035 | A | 12/1993 | Hartunian | |
| 5,645,319 | A | 7/1997 | Parks, Jr. | |
| 6,042,185 | A | 3/2000 | Cowgur | |
| 6,158,813 | A * | 12/2000 | Karash | 297/391 |
| 6,371,428 | B1 * | 4/2002 | Zorich et al. | 248/311.2 |
| 6,427,273 | B1 | 8/2002 | Berke et al. | |
| 6,619,733 | B2 | 9/2003 | Pearson | |
| 6,647,573 | B2 | 11/2003 | Corbin | |
| 6,684,431 | B2 * | 2/2004 | Splane, Jr. | 5/657 |
| 6,698,045 | B1 * | 3/2004 | Coppens et al. | 5/637 |
| 6,718,581 | B2 | 4/2004 | Riach | |
| 6,721,978 | B1 | 4/2004 | Tankersley | |
| 6,805,403 | B2 | 10/2004 | Buch | |
| 6,814,404 | B2 | 11/2004 | Jensen | |
| 6,857,149 | B2 | 2/2005 | Hoggatt et al. | |
| 6,973,691 | B1 | 12/2005 | Cordova et al. | |
| 7,036,168 | B1 | 5/2006 | Knickerbocker | |
| 7,546,651 | B2 | 6/2009 | Groteke et al. | |
| 7,640,609 | B2 | 1/2010 | Roleder et al. | |
| 7,644,990 | B2 | 1/2010 | Pearson | |
| 7,748,064 | B2 | 7/2010 | Hamilton | |
| 7,788,751 | B1 * | 9/2010 | Diemer et al. | 5/644 |
| 7,878,329 | B1 * | 2/2011 | McCarron et al. | 206/521 |
| 7,958,582 | B1 | 6/2011 | Scamardo | |
| 8,011,731 | B2 | 9/2011 | Goddu | |
| 8,176,587 | B2 | 5/2012 | Matt et al. | |
| 8,336,142 | B1 * | 12/2012 | See et al. | 5/634 |
| 2001/0027993 | A1 * | 10/2001 | Smith et al. | 229/168 |
| 2001/0052480 | A1 * | 12/2001 | Kawaguchi et al. | 206/736 |
| 2003/0167571 | A1 | 9/2003 | Corbin | |
| 2003/0172462 | A1 * | 9/2003 | Hoggatt et al. | 5/657 |
| 2006/0191811 | A1 * | 8/2006 | Fogle et al. | 206/434 |
| 2007/0241017 | A1 * | 10/2007 | Sutherland et al. | 206/434 |
| 2008/0029423 | A1 * | 2/2008 | Davlin et al. | 206/522 |
| 2008/0217210 | A1 * | 9/2008 | Banwarth | 206/736 |
| 2011/0186476 | A1 * | 8/2011 | Poitevin | 206/736 |
| 2012/0043241 | A1 * | 2/2012 | Fogle et al. | 206/434 |
| 2012/0278993 | A1 * | 11/2012 | Gard et al. | 5/640 |
| 2013/0032500 | A1 * | 2/2013 | Thivolet | 206/320 |
| 2013/0232696 | A1 * | 9/2013 | Halimi et al. | 5/640 |

FOREIGN PATENT DOCUMENTS

| | | | |
|---|---|---|---|
| WO | 02/38013 | A2 | 5/2002 |
| WO | 2005/060797 | A1 | 7/2005 |
| WO | 2006138298 | | 12/2006 |
| WO | 2009/061077 | A2 | 5/2009 |

OTHER PUBLICATIONS

"Wearable pillow facilitates desktop power naps", located at www.springwise.com/lifestyle_leisure/ostrichpillow/.

"Deeper Sleeper Travel Headrest in Action" [online], Jun. 11, 2009, [retreived on Apr. 3, 2013]. Retrieved from the Internet: <URL: hppt://www.youtube.com/watch?v=Ub5HLdo5hRI &noredirect=1>.

"eZsnooZ All Purpose Travel Cushion" [online], Jul. 21, 2008, [retrieved on Apr. 3, 2013]. Retrieved from the Internet: <URL: http://www.youtube.com/watch?v=lEaenYh-jFg &feature=endscreen&NR=1>.

* cited by examiner

SUPPORT DEVICE AND METHODS

PRIORITY CLAIM

This application claims the benefit of U.S. Provisional Patent Application No. 61/635,144 titled "Collapsible head support" of Steven W. Rasmussen and filed on Apr. 18, 2012, incorporated by reference in its entirety as though fully set forth herein.

BACKGROUND

When a person is travelling, and particularly when a person is in transit on, for example, an airplane, a train, a bus, (or even a car), the person is generally limited to a seated position. The seating areas on these (and other) forms of transportation are typically confined spaces, making it difficult for passengers to rest comfortably. Specially formed pillows are commercially available which fit or wrap behind a person's neck. But these pillows still require the person's head to remain in a generally upright position. Other pillows, such as those used on beds or as "throw" pillows, are also commercially available, but these can be bulky.

DETAILED DESCRIPTION

A head support is disclosed as it may be configured to collapse for ready transport, and assembled for use to support a user's head, for example when the user is seated in forward-facing manner such as in the passenger area of an airplane, bus, train, or car (although other uses are also contemplated). The head support can be readily collapsed into a thin profile to facilitate transport (e.g., in a briefcase, carryon luggage, or carried by itself). When opened, the head support can be positioned on a tray table or other surface, or even straddling a user's lap.

While the head support is illustrated herein as it may be used by passengers on airplanes, busses, in automobiles or other transportation vehicles, the head support is not limited to any particular use. Indeed, the head support may be used anywhere the user desires (e.g., in the waiting room of a doctor's office or at home). Uses other than as a head support are also contemplated, such as but not limited to use as a lectern or a support for a personal computer such as a laptop or a tablet.

Before continuing, it is noted that as used herein, the terms "includes" and "including" mean, but is not limited to, "includes" or "including" and "includes at least" or "including at least." The term "based on" means "based on" and "based at least in part on."

Figure 1:
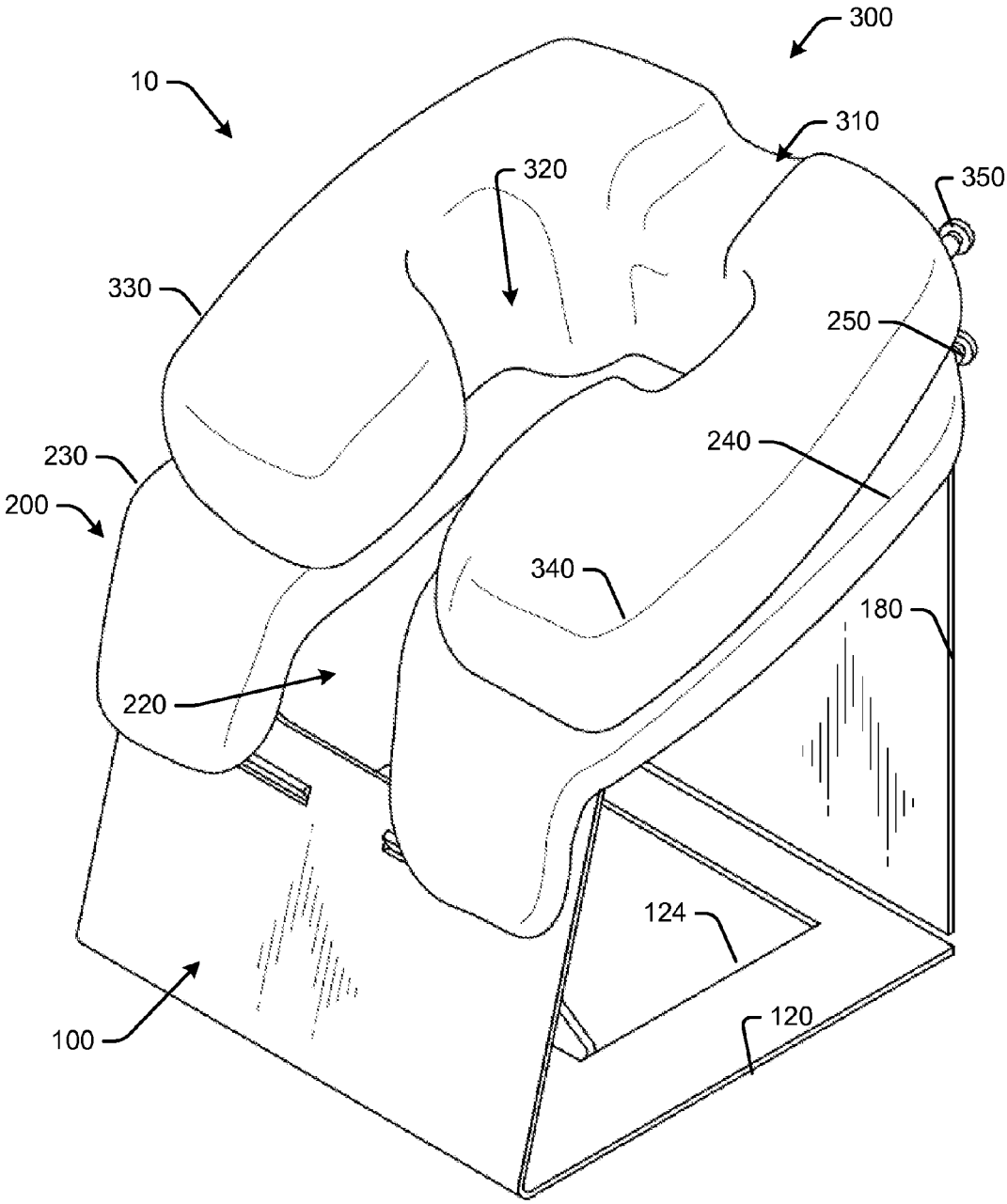
FIG. 1 is a perspective view of an example collapsible head support.

FIG. 1 is a perspective view of an example collapsible head support. The head support 10 is shown as it may have a frame 100. Frame 100 may be constructed of any of a variety of durable, lightweight materials with enough rigidity to generally resist flexion while frame 100 supports a user's head. Example materials include, but are not limited to, plastics, woods, metals papers, composites and/or combinations of these or other materials.

The head support 10 is also shown as it may include a pad 200 and/or a cushion 300, such as a pillow (inflatable or stuffed) which may be provided for contact with a user's forehead (e.g., to rest his or her head). The pad 200 is shown as it may be configured to engage support 160 at a top surface. Pad 200 may also have left arm 230 and right arm 240 partially defining an opening 220. An inflatable pad 200, such as the one shown in the drawings, may also have an inlet 250 allowing for input of air or other fluid to a hollow interior of pad 200. Inlet 250 may be, for example, a nozzle configured for the mouth of a user such that the user may manually blow air into pad 200. Alternatively, inlet 250 may be configured to mate with a small manual or electrically powered pump.

While in the example depicted in the drawings, the pad 200 is shown having a generally 'U' shape, it may be formed in any of a variety of shapes capable of comfortably supporting a user's head. For example, separated ends of the arms 230 and 240 may be joined such that pad 200 has an 'O' or oval shape. Other shapes and/or styles of pads or pillows are also contemplated.

Pad 200 may be constructed of a variety of materials including mesh or foam. In an example, pad 200 may have a foam core surrounded by a fabric or vinyl sheath or mesh. The pad 200 may be also provided without a distinct core, such as in an example including a hollow interior configured to receive a pressurized fluid such as air.

The pillow top or cushion 300 is shown as it may be configured to engage an outer surface of pad 200 or the top surface of support 160. Cushion 300 further comprises left 330 and right 340 arms partially defining an opening 320. A trough 310 may be provided in a configuration to cradle a forehead of a user. Cushion 300 may further comprise an inlet 350 allowing for input of air to a hollow interior of cushion 300. As with pad 200, inlet 350 may be, for example, a nozzle configured for the mouth of a user such that the user may manually blow air into pad 300. Alternatively, inlet 350 may be configured to mate with a small manually or electrically powered pump.

While in the example depicted cushion 300 has a 'U' or 'C' shape, it may be formed in any of a variety of shapes capable of comfortably supporting a user's head. For example, separated ends of arms 330 and 340 may be joined such that cushion 300 has an 'O' shape.

Cushion 300 may be constructed of a variety of materials including mesh or foam. In some examples, cushion 300 may include a foam core surrounded by a fabric or vinyl sheath or mesh. In examples including a hollow interior configured to receive a pressurized fluid such as air, cushion 300 may be provided without a distinct core.

It is noted that the pad 200 and cushion 300 may be provided as separate components, or may be integral to one another and/or include separate air chambers but be connected to one another.

Figure 2:
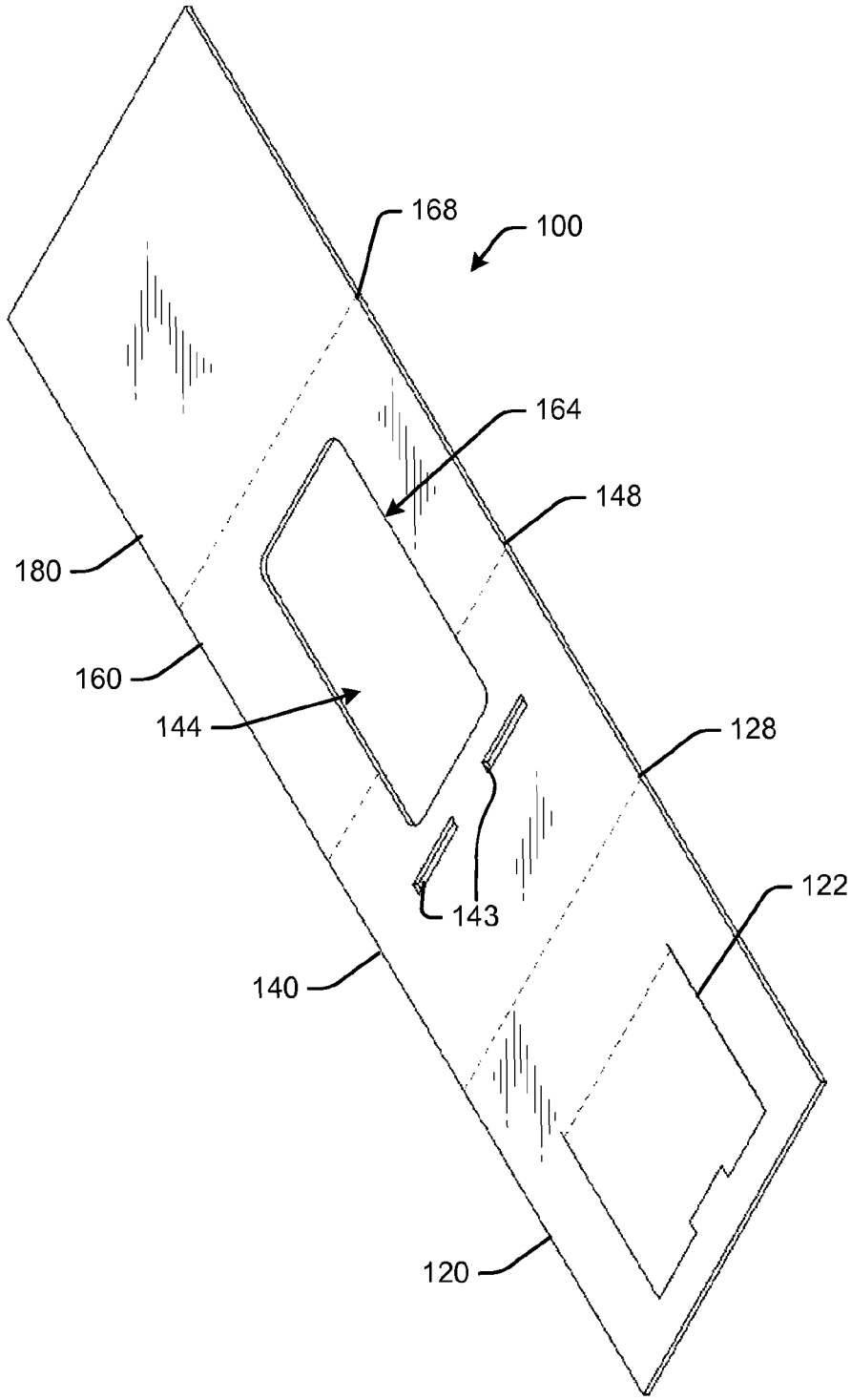
FIG. 2 is a perspective view of the example collapsible head support with a frame portion shown in a collapsed position.
Figure 3:
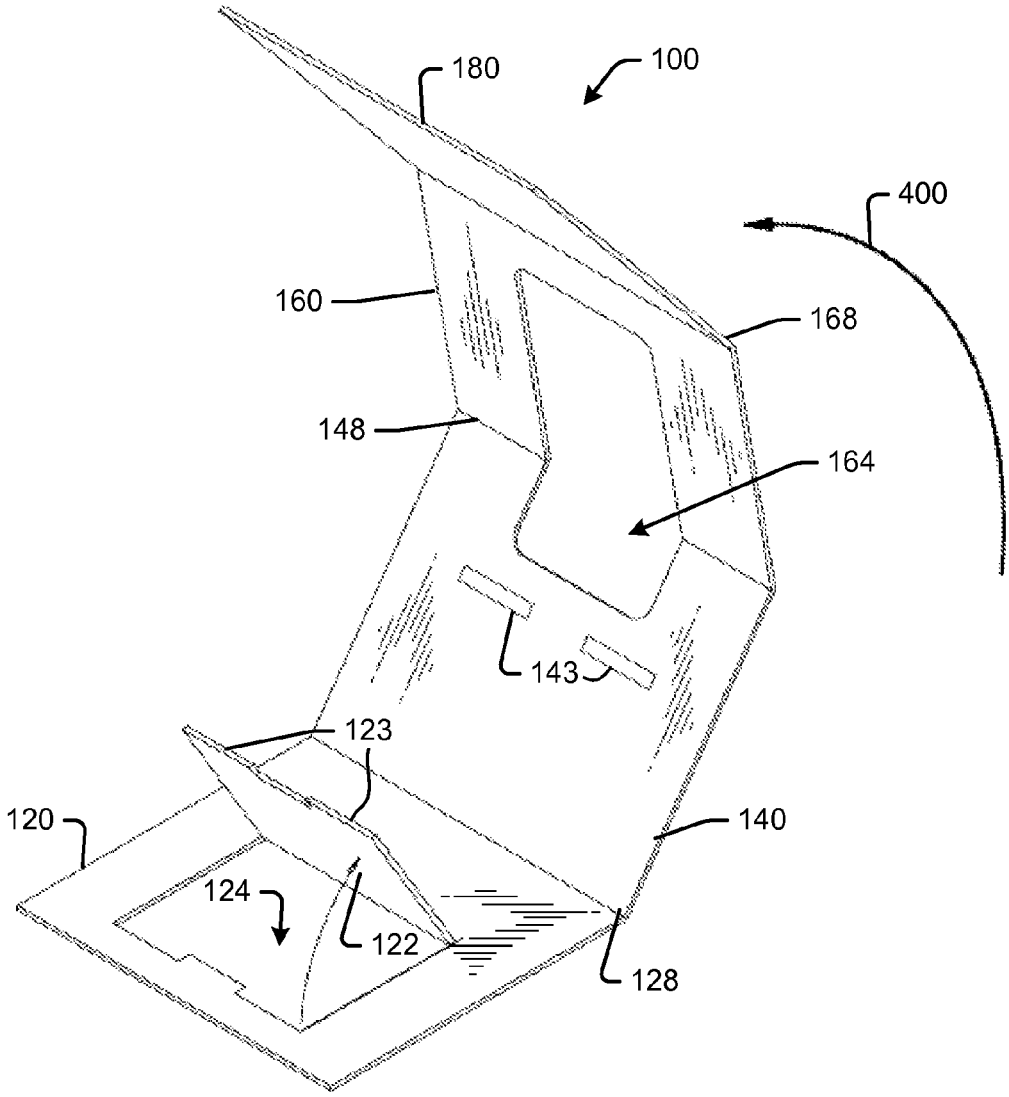
FIG. 3 is a perspective view of the example collapsible head support illustrating assembly of the frame portion.

FIG. 2 is a perspective view of the example collapsible head support with a frame portion shown in a collapsed position. FIG. 3 is a perspective view of the example collapsible head support illustrating assembly of the frame portion.

In an example, the frame 100 includes a base 120, a first elevator or front riser 140, a support surface 160 capable of supporting a face of a user, and a second elevator or rear riser 180 capable of elevating the supporting surface 160. The front riser 140 and rear riser 180 function as elevating means to space the support surface 160 in a position elevated from the base 120 to support the head of a user. Support surface 160 also connects front riser 140 and rear riser 180.

The lengths, widths, and angles of frame 100 and components 120, 140, 160 and 180 may be adjustable to accommodate different size users and/or different user positions. While depicted as having generally planar, rectangular shapes, frame components 120, 122, 140, 160 and 180 may take any of a variety of forms. For example, component edges or surfaces or both may include curves or angles.

In an example, the components 120, 140, 160 and 180 may be considered to include a central plane passing through their centers and intersecting with their edges in a way generally dividing each edge into portions of equal thickness. While components 120, 140, 160 and 180 may take any of a variety of shapes, when taking generally planar shapes, the central planes are oriented parallel to the outer surfaces of greatest area.

In an example, the front riser 140 is pivotably coupled with the base 120 along a hinge 128. The support surface 160 is pivotably coupled with the front riser 140 along a hinge 148. The rear riser 180 is pivotably coupled with the support surface 160 along a hinge 168. A hinge may also be provided to pivotably couple base 120 to rear riser 180 and one or more of hinges 128, 148 and 168 may be eliminated.

The hinges may be provided by any of a variety of structures which are generally configured to enable relative pivoting of adjacent panels. By way of example, a thin flexible material may join adjacent panels, or the hinges may include a pin and clevis type device.

In an example, the rear riser 180 may be removably engaged to the base 120 during assembly with any suitable engagement device, such as but not limited to a hook-and-loop (e.g., VELCRO®) tab, snaps, buckle, or other removable connector. In another example, any or all of the panels of the head support may be removably engaged with one another. In yet another example, all of the four panels of the head support are connected so as not to disengage from one another, but rather to fold relative to one another. For example, the rear riser 180 may be connected to base 120 so as not to disengage, as described for the folding connection between the other panels. The head support 10 thus folds between a flat or collapsed configuration and an assembled configuration similar to a cardboard box having four sides but with the top and bottom ends open for folding.

In an example, a brace 122 may be provided to reinforce the front riser 140, provide additional stability to head support 10 and maintain the riser 140 in an upright position during use. The brace 122 may include tongues 123 receivable by slots 143 provided in the front riser 140.

It is noted that additional features may be provided for the frame 100, pad 200, cushion 300 and/or each of these, including for example, storage pockets, handles, and hand rest straps.

Figure 5:
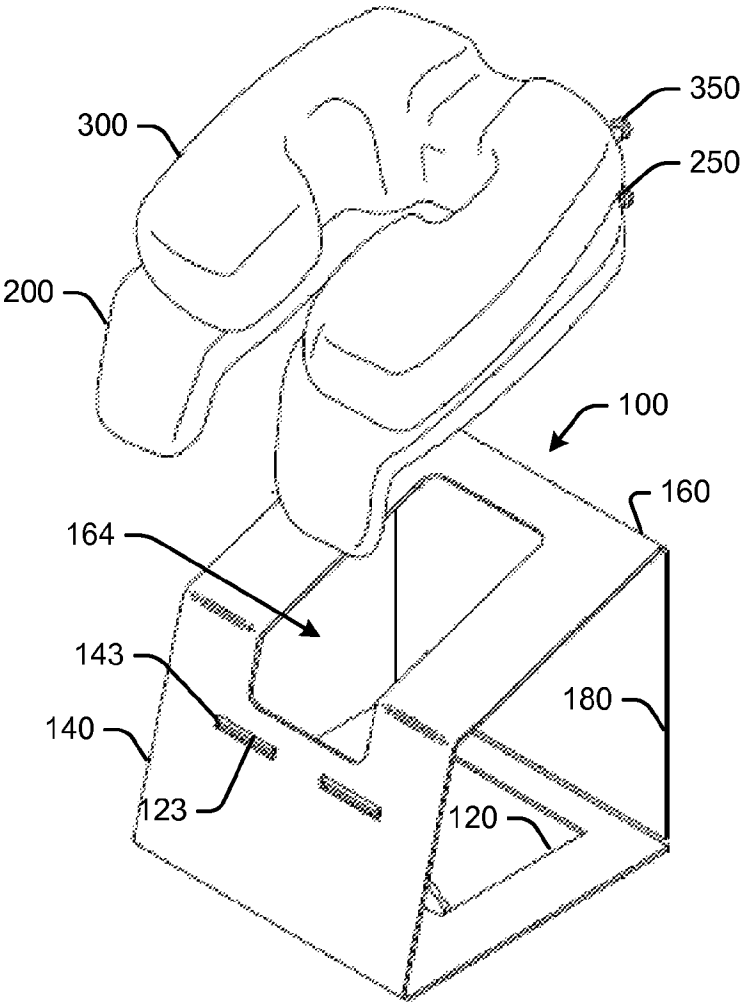
FIG. 5 is a front perspective view of the example collapsible head support illustrating assembly of a pillow or pad onto the frame portion.
Figure 4:
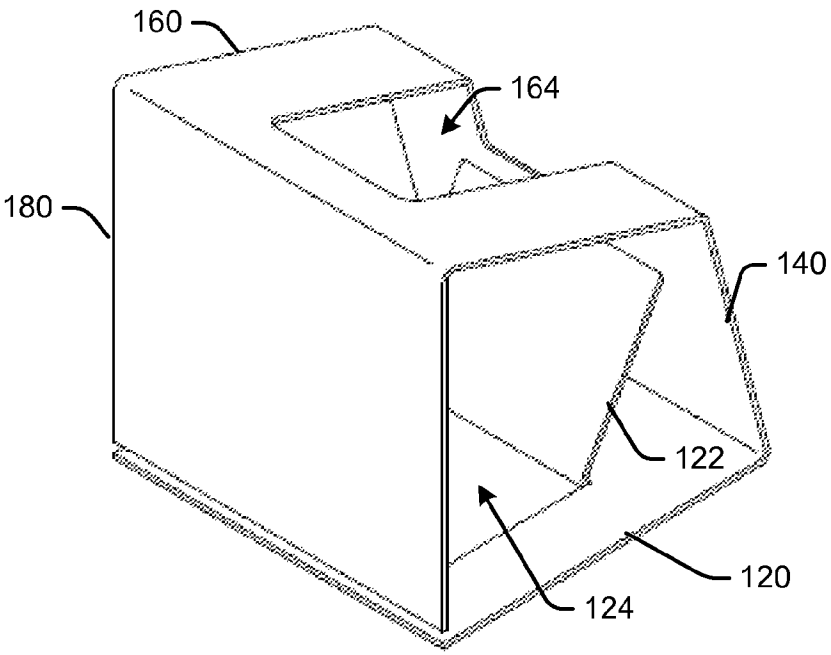
FIG. 4 is a rear perspective view of the example collapsible head support with the frame portion shown assembled.

FIG. 4 is a rear perspective view of the example collapsible head support with the frame portion shown assembled. FIG. 5 is a front perspective view of the example collapsible head support illustrating assembly of a pillow or pad onto the frame portion.

The central plane of brace 122 is shown as it may be configured to pivot away from an orientation parallel with the central plane of base 120. To maintain a low profile when brace 122 is positioned parallel with base 120, a window or depression 124 may be provided in the outer surface of base 120 to receive the brace 122. In an example, magnets or other attachment may be used to hold brace 122 in a desired position.

A receiving device may be formed in the support surface 160, and configured to receive the user's mouth and nose to provide unobstructed airflow for breathing. In an example, window 164 functions as the receiving device. The window 164 may be effectively extended into the front riser 140, e.g., by a cut-out 144.

While window 164 is configured to receive the mouth and nose of a user, it may also enable the user to view something interior to frame 100. For example, a tablet computing device, phone, music player (or other electronic device) may be provided to base 120 so as to be readily viewed by the user through the window 164. The user may also place a magazine, book, papers, etc. on the base 120 to view through the window 164.

Figure 6:
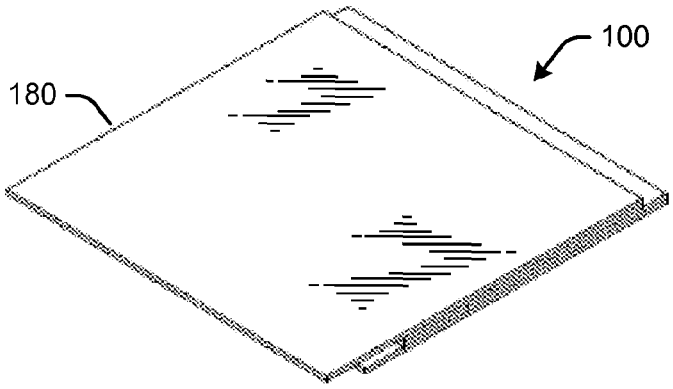
FIG. 6 is a perspective view of an example frame of the example collapsible head support shown fully collapsed.

The frame 100 may be configurable into a variety of dispositions. FIG. 6 is a perspective view of an example frame of the example collapsible head support shown fully collapsed. In this disposition, central planes of base 120, front riser 140, support 160 and rear riser 180 are all substantially parallel to one another, and the frame 100 thus has a thin profile to facilitate transport (e.g., in a briefcase, in carry-on luggage, or carried by itself).

Assembly is illustrated from a substantially flat configuration shown in FIG. 6, with reference to the sequence shown in FIGS. 2-5. According to an example assembly operation, the central plane of front riser 140 extends at angles relative to the base 120 and support 160 central planes. The angles between respective central planes may be about 90 degrees or may be any of a variety of angles conducive to distancing support 160 from base 120 at an angle facilitating comfortable support of a user's head.

In the erect or fully assembled disposition, the central plane of front riser 140 extends substantially parallel to rear riser 180 central plane. While in this substantially parallel orientation, the central planes may extend at angles to one another that are substantially less than 45 degrees. For example, while substantially parallel, the central planes may extend at angles of about 10 degrees to one another.

In the assembled disposition, the central plane of support 160 may extend at an angle to base 120 central plane. In some examples, this angle may be a relatively small angle (e.g., 10 degrees). However, the support 160 central plane may extend, relative to base 120 central plane, at any of a variety of angles conducive to facilitating support of a user head.

In the assembled disposition, the central of plane base 120 may extend at an angle relative to rear riser 180 central plane. The angles between respective central planes may generally be about 90 degrees or may be any of a variety of angles conducive to distancing support 160 from base 120 at an angle facilitating support of a user's head.

In the assembled disposition, central plane of support 160 extends at an angle to rear riser 180 central plane. Then angle between these central planes may generally be about 90 degrees or may be any of a variety of angles conducive supporting a user's head. In some examples, the angle between support 160 and rear riser 180 may be somewhat less than 90 degrees, for example, 80 degrees.

In the assembled disposition, the brace 122 may extend at an angle relative to the central plane of base 120, and tongues 123 may be received into pockets 143.

An example method for supporting a head will now be described. In this example, the frame 100 is configurable between collapsed (see FIGS. 2 & 6) and assembled positions (see FIGS. 1, 4, 5, 7 & 8) is provided to include a base 120, a front riser 140 pivotably coupled with base 120, a support 160 pivotably coupled with front riser 140, and a rear riser 180 pivotably coupled with support 160. Details of other provisions of support device 10 are described above.

To place frame 100 into the assembled disposition from the unfolded, collapsed disposition (see FIG. 2), the front riser 140 is pivoted relative to base 120 along hinge 128, support 160 is pivoted relative to front riser 140 along hinge 148 and rear riser 180 is pivoted relative to support 160 along hinge 168 as indicated by arrow 400.

With pivoting, the central plane of front riser 140 is configured at an angle relative to the central plane of base 120 and relative to the central plane of support 160 while the central plane of rear riser 180 is configured at an angle relative to the central plane of base 120 and the central plane of support 160.

After pivoting, the angle between the central plane of riser 140 and each of the central planes of base 120 and support 160 may generally be about 90 degrees. The angle between the central planes of rear riser 180 and base 120 may be about 90 degrees. The angle between the central planes of support 160 and rear riser 180 may be about 90 degrees. In some examples, the angle between support 160 central plane and rear riser 180 central plane may be somewhat less than 90 degrees, for example, about 80 degrees.

Pivoting may further configure the central plane of support 160 at an angle relative to the central plane of base 120. In some examples, the angle between the central plane of support 160 and the central plane of base 120 may be a relatively small angle, such as about 10 degrees. However, in some examples, support 160 and base 120 may be substantially parallel when frame 100 is in the expanded disposition.

Meanwhile, pivoting of front riser 140, support 160 and base 180 configures the central plane of front riser 140 substantially parallel with the central plane of rear riser 180. In some examples, substantially parallel may be angles substantially less than about 45 degrees, for example, about 10 degrees.

For added stability in the assembled disposition, brace 122 may be pivoted away from base 120 to engage with front riser 140 at an angle substantially less than 90 degrees. For example, brace 122 may intersect front riser 140 at about 45 degrees.

With frame 100 configured in the expanded disposition, a user may apply pad 200, cushion 300 or both to frame 100 (see FIG. 5). In an example including inlet 250 and/or inlet 350, a user may provide pressurized air to pad 200 or cushion 300, respectively, either under lung power or by use of a pump (not illustrated).

Figure 7:
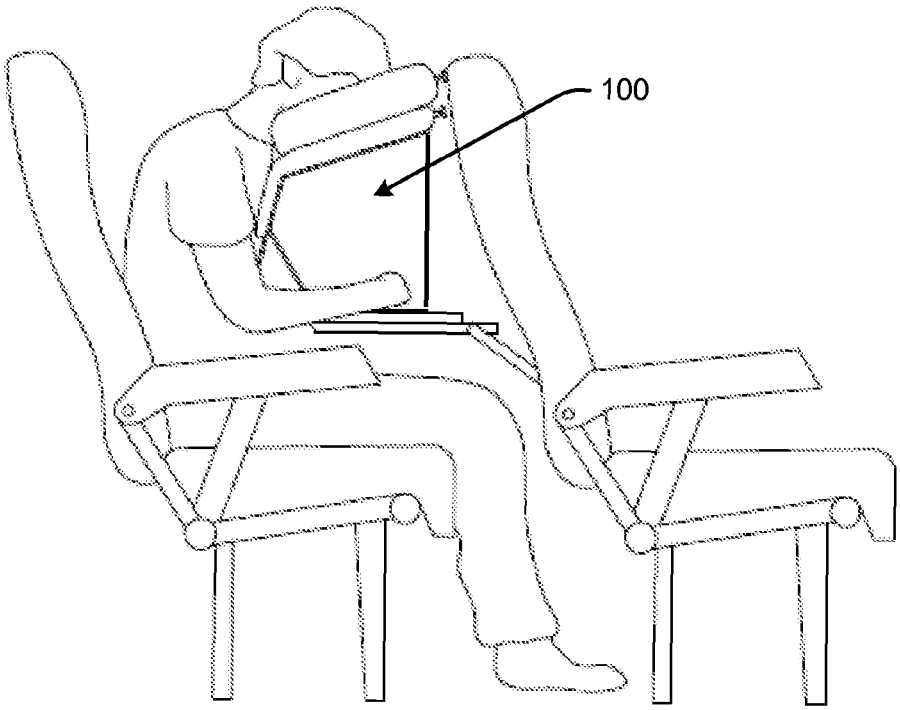
FIG. 7 is a side view of the example collapsible head support illustrating in use when supported on a tray table.
Figure 8:
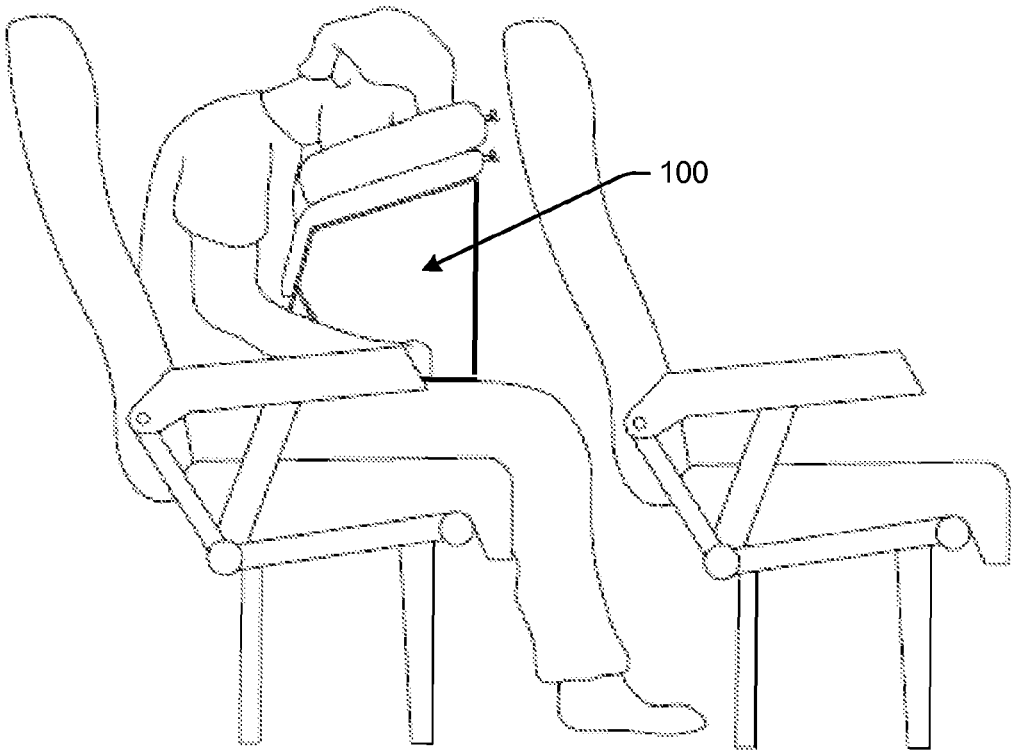
FIG. 8 is another side view of the example collapsible head support illustrating use when supported on the legs of a user.

When in the assembled disposition, head support 10 can be placed on a tray table or seat (on or straddling the user's lap). FIG. 7 is a side view of the example collapsible head support illustrating in use when supported on a tray table. FIG. 8 is another side view of the example collapsible head support illustrating use when supported on the legs of a user. The user may then lean forward such that the head support provides a support surface for the user's head and face in a seated, forward facing manner.

After use, brace 122 may be disengaged from front riser 140, and continued pivoting of components 140, 160, and 180 yields a collapsed and folded disposition, in which the central plane of base 120 is configured again substantially parallel to the central planes of front riser 140, support 160 and rear riser 180 (see FIG. 6).

In order to arrive at the disposition of FIG. 6, a user may first completely pivot rear riser 180 from contact with support 160, then completely pivot support 160 such that rear riser 180 contacts front riser 140 and finally completely pivot front riser 140 such that support 160 contacts base 120. Again, pivoting direction is illustrated by arrow 400 shown in FIG. 3.

In another example, with rear riser 180 pivoted into contact with support 160, a user may next pivot base 120 into contact with front riser 140 and finally pivot front riser 140 and support 160 such that rear riser 180 and base 120 are in contact.

To transport or store the support 10, a user may remove pad 200, cushion 300 or both from frame 100 and disengage tongues 123 from pockets or slots 143. The pivoting described above to place frame 100 in the assembled disposition may be reversed until frame 100 is in the collapsed disposition of FIG. 2. From this disposition, frame 100 may be again pivoted in the forward direction (see FIG. 3) into the collapsed, folded configuration (see FIG. 6).

The operations shown and described herein are provided to illustrate example implementations. It is noted that the operations are not limited to each of the steps and/or the ordering shown. For example, it may not be necessary to configure frame 100 into the disposition of FIG. 2 before configuring into the collapsed, folded configuration. Still other operations may also be implemented. For example, partial pivoting away from the assembled disposition may allow for re-configuration into the collapsed, folded configuration.

It is noted that the examples shown and described are provided for purposes of illustration and are not intended to be limiting. Still other examples are also contemplated.

The invention claimed is:

1. A support device configurable between a collapsed disposition and an assembled disposition, the support device having a one-piece frame comprising:

a base;

a front riser pivotably coupled with the base;

a support surface pivotably coupled with the front riser, the support surface including a window formed therein;

a rear riser pivotably coupled with the support surface;

further comprising a pad configured to engage the support at an outer surface thereof;

further comprising a cushion configured to engage an outer surface of the pad;

wherein the cushion is inflatable; and wherein the cushion further comprises a trough configured to cradle a user forehead.

2. The support device of claim 1, wherein in the collapsed disposition, central planes of the base, the front riser, the rear riser, and the support surface are substantially parallel.

3. The support device of claim 1, wherein in the assembled disposition, central planes of the front riser and the rear riser are substantially parallel to one another, and central planes of the base and the support surface are at angles less than about 90 degrees relative to the central planes of the front riser and the rear riser.

4. The support device of claim 1, wherein in the assembled disposition, a brace is inserted into a pocket in the front riser.

5. The support device of claim 4, further comprising providing the brace as a cut-out foldable portion of the base.

6. The support device of claim 1, wherein, in the assembled disposition, an object is viewable on the base by a user's face above the window formed in the support surface.

7. The support device of claim 1, further comprising both a removable pad and a removable cushion on the support surface.

8. The support device of claim 1, wherein the window is conjoined with a cut-out provided in the front riser.

9. The support device of claim 1, wherein the base, the front riser, the support surface, and the rear riser are each formed in a single plane, the single plane foldable between a substantially flat position and a substantially erect position.

10. A one-piece head support, comprising:

means for supporting a face of a user;

means for elevating the supporting means to support the face of the user when the user is seated in a generally upright position, wherein the means for elevating the supporting means is constructed as a single panel, the single panel foldable between a substantially flat configuration and an erected configuration;

further comprising a pad configured to engage the support at an outer surface thereof;

further comprising a cushion configured to engage an outer surface of the pad;

wherein the cushion is inflatable; and wherein the cushion further comprises a trough configured to cradle a user forehead.

11. The head support of claim 10, further comprising means for bracing the elevating means and means for receiving the bracing means in the supporting means.

12. A method for supporting a user's head in a seated position, the method comprising:

providing a frame configurable between collapsed and erect dispositions and including a base;

providing a brace for the frame;

pivoting a front riser coupled with the base;

pivoting a support surface coupled with the front riser and having a window formed therein; and pivoting a rear riser coupled with the support surface to support the user's head on the support surface when the user is in a seated position, wherein the frame, brace, front riser, support surface, and rear riser are manufactured as a single unit;

configuring the front riser at an angle relative to a central plane of the base; configuring the front riser at an angle relative to a central plane of the support surface; and configuring the front riser substantially parallel to a central plane of the rear riser; configuring the base at an angle relative to the support surface;

configuring the base at an angle less than about 90 degrees relative to the rear riser;

and configuring the support surface at an angle relative to the rear riser.

13. The method of claim 12, further comprising configuring a central plane of the base substantially parallel to the front riser, the support surface, and the rear riser.

14. The method of claim 12, further comprising providing the base, the front riser, the support surface, and the rear riser in a single plane foldable between a substantially flat position and a substantially erect position.

* * * * *